United States Patent [19]

Plassmeier et al.

[11] Patent Number: 4,974,535

[45] Date of Patent: Dec. 4, 1990

[54] METHOD AND APPARATUS FOR SEWING A SEAM ENDING AT A PREDETERMINED LOCATION

[75] Inventors: Horst Plassmeier, Herford; Heinz Goldbeck, Bielefeld, both of Fed. Rep. of Germany

[73] Assignee: Durkoppwerke GmbH, Fed. Rep. of Germany

[21] Appl. No.: 352,869

[22] Filed: May 17, 1989

[30] Foreign Application Priority Data

May 30, 1988 [DE] Fed. Rep. of Germany ..... 3818457

[51] Int. Cl.[5] ..... D05B 69/22; D05B 69/18

[52] U.S. Cl. ..... 112/262.1; 112/272; 112/275; 112/317

[58] Field of Search ..... 112/275, 272, 315, 121.11, 112/121.12, 262.1, 2, 316, 317, 277

[56] References Cited

U.S. PATENT DOCUMENTS

| | | | |
|---|---|---|---|
| 4,491,080 | 1/1985 | Hager | 112/275 |
| 4,548,143 | 10/1985 | Martell et al. | 112/275 X |
| 4,587,915 | 5/1986 | Wenz et al. | 112/275 |

FOREIGN PATENT DOCUMENTS

| | | | |
|---|---|---|---|
| 3150141C1 | 12/1981 | Fed. Rep. of Germany | 112/275 |

*Primary Examiner*—Peter Nerbun

*Attorney, Agent, or Firm*—Ostrolenk, Faber, Gerb & Soffen

[57] ABSTRACT

By means of this method and apparatus for sewing a seam, it is possible to end a seam exactly at a predetermined location. When the predetermined location is reached, the forward movement of the sewing material is interrupted, and only the stitch that had been begun at the time of the interruption is completed. In this way, on the one hand, visually attractive seams can be produced and, on the other hand, it is possible to sew a small part onto a main part with a seam which does not extend past the small part.

24 Claims, 6 Drawing Sheets

METHOD AND APPARATUS FOR SEWING A SEAM ENDING AT A PREDETERMINED LOCATION

BACKGROUND OF THE INVENTION

The invention relates to a method and apparatus for producing a seam and is capable of stopping the formation of stitches precisely at a predetermined location.

The problem of producing a seam with an exact length always arises where two workpieces must be sewn to each other in a visible location and the course of the seam must not extend over the edge of the sewn-on workpiece; or in the production of a corner seam where the seam end must be equidistant from both workpiece edges.

In both cases, the formation of stitches must be ended at a location exactly definable in advance in order to produce a visually unobjectionable seam: in the first case, at the end of the sewn-on workpiece; in the second, at the point that is the same distance from both edges of the workpiece to be sewn.

Various devices intended to produce such seams are known.

German Unexamined Patent Application No. OS 30 18 797 discloses a sewing machine with a stitch-counter correction device which assures that the actual seam end deviates by a maximum of one-half stitch length from the desired seam end. Whether such deviation is in front of or beyond the desired end depends on what percentage of the stitch being formed is complete at the time when the approaching desired seam end is detected.

European Patent No. 0 068 625 discloses a stitch-length monitoring device for sewing machines. With this monitoring device it is possible to obtain a precision of one-fourth stitch in the desired seam length. Here too, the desired seam end is detected several stitches in advance, and a variable number of stitches to be made is calculated by a control means. The number of stitches still to be executed after detection can be increased by a half or a full stitch length, depending on the degree of completion of the stitch at the time of detection. The stated precision is achievable in conjunction with a reversal of the advance of the workpiece.

European Patent No. 0 102 524 discloses a drive and control device for sewing machines in which device the desired seam end is likewise detected several stitches in advance. A correction means varies the length of at least one of the remaining stitches as a function of the instantaneous position of the needle at the time of the detection of the end, so that the last point of insertion of the needle lies as close as possible to the desired end.

Here the degree of deviation of the actual end from the desired end depends on the number of remaining stitches and the possibility of varying their length. A correction of the stitch lengths is then practical only if the deviation from the desired end is greater than half of a correction stitch.

With none of these known devices is it possible to reliably position the final point of insertion exactly at the desired location.

SUMMARY OF THE INVENTION

Accordingly, the general object of the invention is to provide a method by which the formation of stitches within a seam can be ended in a reproducible manner at a location defined in advance.

A further object is to provide an apparatus for carrying out the method.

This object is attained by a sewing apparatus and method in which a seam is sewn in a workpiece ending at a predetermined end point, by means of an automatic sewing machine having a drivable, ascending and descending needle, a workpiece transport device, and drive means for driving the needle and the workpiece transport device. The drive means can comprise, for example, a single motor connected to the sewing machine and to the workpiece transport device by appropriate drive belts, clutches and gearboxes, or respective motors for the sewing machine and the workpiece transport device.

The seam is sewn by employing the workpiece transport device to move the workpiece in a forward direction under the needle. When the workpiece reaches a predetermined location, with the needle being at the desired seam end point, the forward movement of the workpiece is automatically interrupted. This may be done, for example, by disengaging a drive belt from the workpiece transport device, or by stopping the separate motor assigned to said workpiece transport device. Then the system automatically completes the formation of any last stitch which had been begun at the time of the movement interruption, but no additional forward stitches are made. The needle and the transport device are interrupted simultaneously, and the interruption of the transport device takes place completely independently of the position of the needle at the time the interruption is to take place. Then the workpiece transport device is disabled and the needle is automatically restarted to complete the formation of the last stitch.

According to a preferred system for monitoring the workpiece movement, the workpiece is first placed in an initial position, a length l of the seam to be sewn is determined, possibly according to the length of the workpiece; a distance L from the end point of the seam to the needle, with the workpiece in the initial position, is determined; then a distance $s=L-l$ is calculated. After these calculations, the workpiece is moved forward toward the needle by the distance s from the initial position. This brings the workpiece into position for sewing the seam. The seam is begun, and continued until the workpiece has additionally been moved the distance l.

The distance the workpiece has moved can be detected, for example, by a distance sensing means associated with the workpiece transport device, such as a rotation sensor that detects how far the transport device has been moved; or an optoelectronic sensor mounted at a sensing point a predetermined distance from the needle, which senses the passage of the edge of a workpiece.

The instantaneous position of the needle, with respect to the bottom dead center point and a predefined needle top position, is determined at the time workpiece movement is interrupted. The system determines the direction of needle movement, and determines whether the bottom dead center point has been reached at this time. If the needle is at the bottom dead center point, or in downward movement, then the needle is returned to the needle top position to complete the last stitch. If the needle is in upward movement at the time workpiece movement is stopped, then the needle movement is continued until the bottom dead center point is passed through again, and then the needle is returned to the needle top position to complete the formation of the last stitch.

According to a further advantageous feature of the invention, after completing such last stitch, the system may restart the drive means to operate the sewing machine but not the workpiece transport device, and then, after the first passage of the needle through the bottom dead center position, engage the workpiece transport device in a reverse direction, to terminate the seam with a predetermined number of backstitches.

With the invention it is possible to interrupt a seam at an arbitrary location, independently of the instantaneous position of the needle at that time. When the desired seam end is reached, the movement of the workpiece is stopped with great precision, with the needle in or over the last point of insertion. Only the stitch just begun is completed, without further workpiece transport, so the end of the seam always lies at the desired predetermined location.

In this way it becomes possible, for example in the sewing of a cuff, to place the final stitch so that the seam ends exactly at the cuff edge.

Although generally the last stitch length will be shortened, for a stitch length chosen appropriately small, the shortening will not be especially visible.

Other objects, features and advantages of the invention will be appreciated in connection with the following detailed description of preferred embodiments thereof, with reference to the drawings.

DETAILED DESCRIPTION

Figure 1:
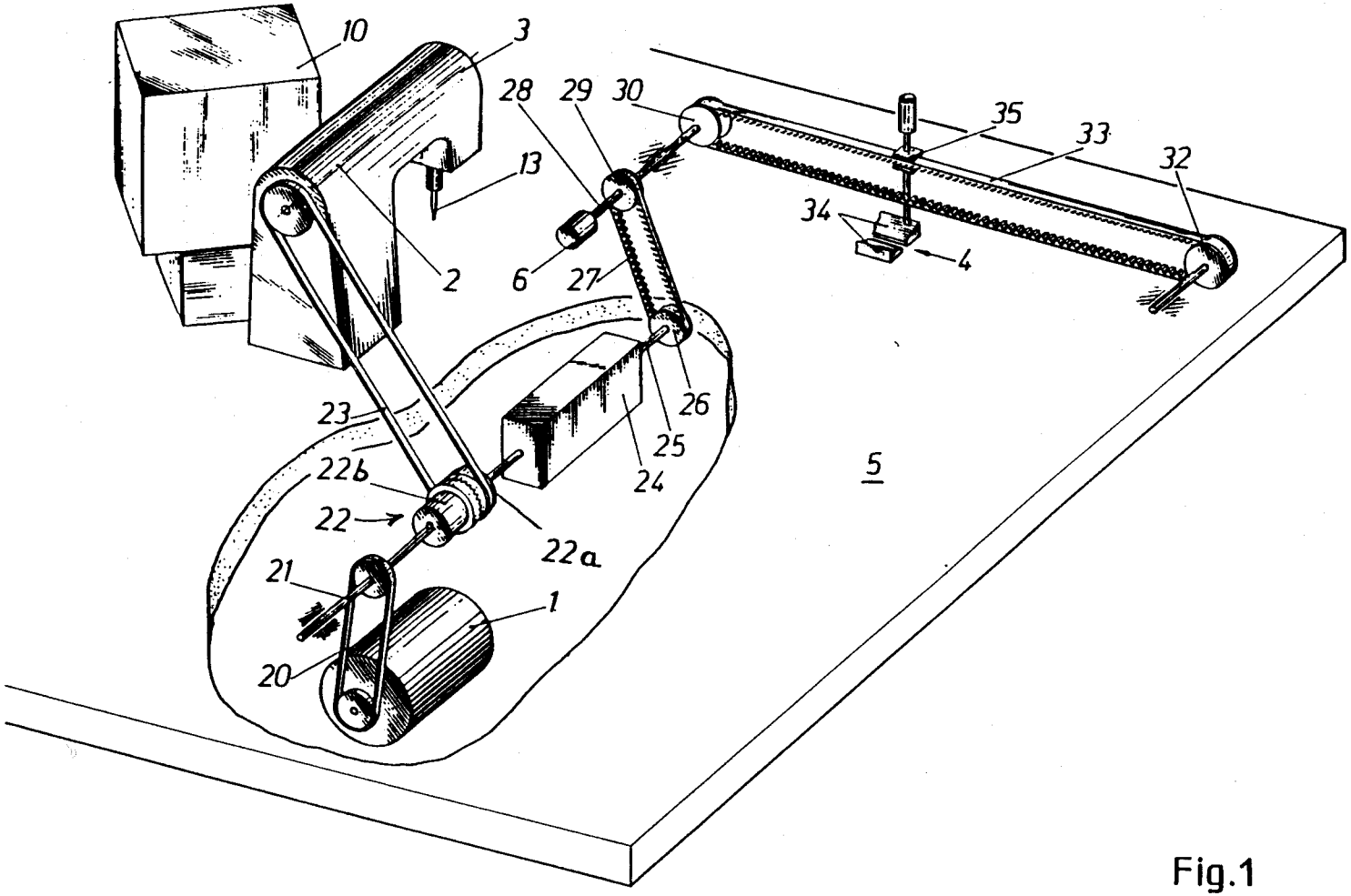
FIG. 1 is a perspective view of the basic components of a sewing machine with a workpiece transport device according to an embodiment of the invention.

FIG. 1 is a perspective view showing the basic components of a sewing machine with a workpiece transport device.

The sewing machine 3 is mounted on a table 5. By means of the transport device 4 arranged on the table 5 behind the sewing machine 3, the workpieces 7, 7*a* to be sewn (see FIGS. 2, 2*a*) are conducted through the sewing machine, under the needle 13. The known transport device 4 consists essentially of a pair of sewing-material clamps 34 and a pneumatically or electromagnetically controlled clamping device 35, 35*a* connected to said clamps. Said clamping device 35, 35*a* can be controlled so as to close on a toothed belt 33 and thereby be moved along the horizontal displacement path of the transport device 4.

The sewing-material clamps 34 are shown greatly shortened in FIG. 1 and must, in practice, be capable of moving and/or extending to near the sewing machine 3.

Beneath the table 5 there are arranged a drive motor 1, a clutch 22, and a toothed-belt drive 26, 27, 29 for the transport device 4.

The motor 1 drives an intermediate shaft 21 via a toothed belt 20. To the intermediate shaft 21 there is firmly attached a clutch disk 22*b* which can be placed in operative engagement with a freely rotatable mating disk 22*a*. The intermediate shaft 21 terminates in a step-down gearbox 24, whose output shaft 25 is provided with the toothed-belt pulley 26. This pulley 26 which drives the transport device 4 via the toothed belt 27, the pulley 29, and the drive shaft 28.

On the drive shaft 28 there is arranged an incremental distance pickup 6 by which the distance traveled by the sewing-material clamps 34 can be determined. This distance pickup 6 is electrically connected to a control means 10 which controls the clutch 22 and the clamping device 35 and/or the motor 1 upon receipt of appropriate signals.

By means of the clutch 22, the upper drive shaft 2 of the sewing machine 3, shown schematically, can be engaged or disengaged at any time.

On the upper drive shaft 2 of the sewing machine 3 there is arranged a known device, not shown, for determining the bottom dead center (BDC) point of the needle 13 and for determining a defined needle top position, said device being electrically connected to the control unit 10. Such devices are disclosed, for example, in DE-OS No. 19 07 975; DE-AS No. 24 14 484; and DE-PS No. 28 37 743, which are all expressly incorporated by reference herein. This defined needle top position can be a position of the upper drive shaft 2 which is a certain angle before or after the top dead center (TDC) point of the needle 13; or can be the top dead center point of said needle.

The method in accordance with the invention will now be explained in more detail.

Figure 2:
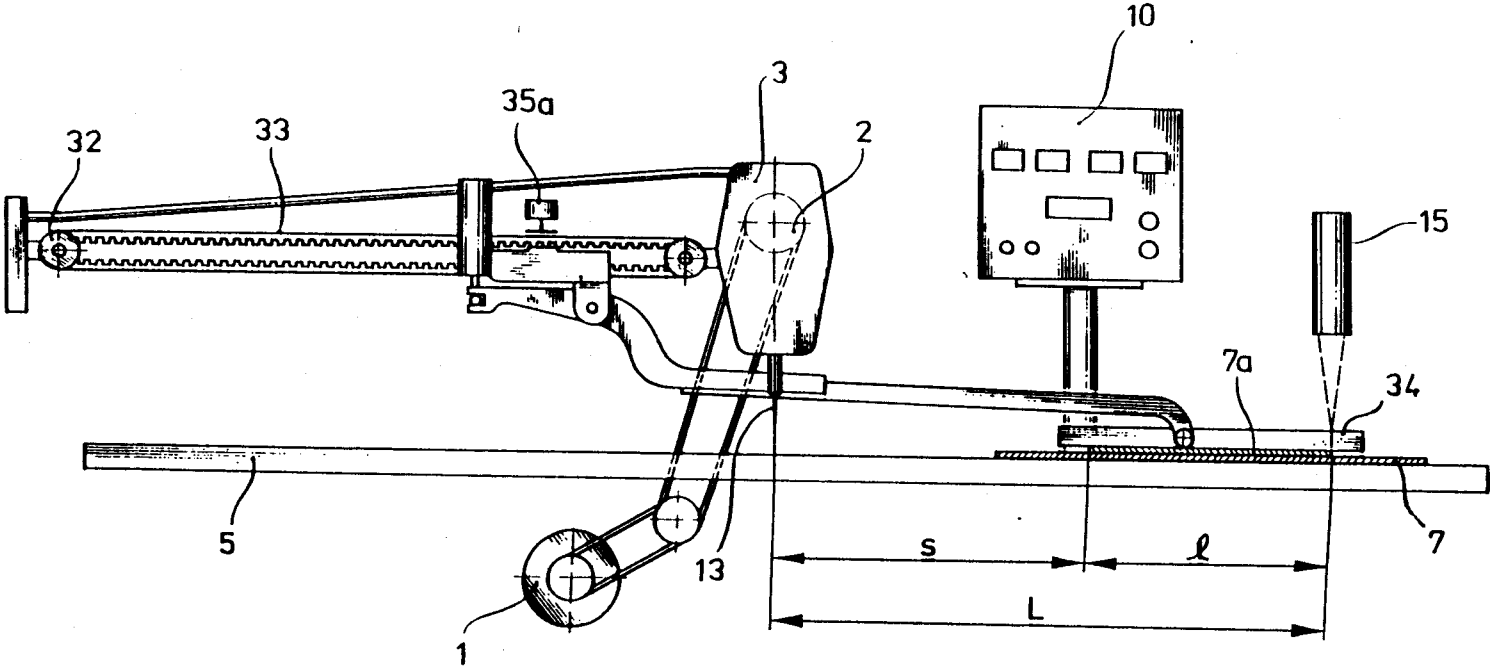
FIG. 2 is a side view of the embodiment of FIG. 1.

Referring to FIG. 2, the length of the seam to be produced is determined according to the length l of the top workpiece 7*a* to be sewn on the bottom workpiece 7.

The transport device 4 is placed in the position for receiving the workpieces, and the workpieces 7, 7*a* are, in known manner, aligned relative to each other and secured in the sewing-material clamps 34. Means for exact positioning are known. This can be accomplished, for example, by a marking light 15 by means of which the rear edge of the top workpiece is aligned. Also known are marks, clips, or the like which may be applied to the top or bottom workpiece and brought into coincidence with corresponding markings on the table 5 or the sewing-material clamps 34.

A device-dependent length L, which extends from the alignment point of the workpiece 7*a*, as established by means of the marking light 15, up to the needle tip, is stored in the control unit 10. The difference between this length L, and the length l of the workpiece 7*a* to be sewn on, is the distance s that the transport device 4 must cover before the first needle insertion can take place. The value l is input to the control unit 10 and stored there, and the transport distance s to be covered without any needle strokes is calculated.

The motor 1 is switched on, with the clutch 22 disengaged and the clamping device 35, 35*a* closed, whereby only the transport device 4 can be driven, not the sewing machine 3. The workpieces 7, 7*a* are moved by the sewing-material clamps 34 in the direction of the needle 13, and the distance covered is determined via a distance pickup 6, forwarded to the control unit 10, and compared there with the calculated value of s.

When the distance covered has attained the value s, the control unit 10 sends a signal to the clutch 22, which thereupon engages, and the sewing process begins. (The workpieces 7, *7a* could also be initially positioned directly under the needle 13 in such a manner that the sewing process could be started immediately, which would make the additional determination of the length s superfluous.)

Then, when the distance pickup 6 has determined that the distance subsequently covered has attained the value of l, a signal goes from the control unit 10 to the brake of the drive motor 1, whereupon said motor is immediately brought to a stop. If the sewing is carried out with the motor operating at a high rotational speed, it may be necessary, shortly before the desired seam end (length l) is reached, to reduce the rotational speed to such an extent that the inertia of the motor will not prevent it from stopping immediately.

The needle 13 is now at the desired seam end, and exactly in or over the last point of insertion. The precision with which the desired end is reached depends only on the resolving power of the distance pickup 6 and on its arrangement. If the rotational speed of the distance pickup 6 relative to the drive shaft 28 is increased, said distance pickup delivers a larger number of pulses for the same transport distance covered by the sewing-material clamps 34, so that the precision of the distance measurement also increases.

From the control unit 10 a signal is given to the pneumatic or electromagnetic system of the clamping device 35, not shown, whereupon said clamping device releases, so that the transport device 4 can no longer be moved horizontally.

Then a renewed signal is sent to the drive motor 1. The motor starts again and the last stitch, which had been begun at the time of stopping, is completed (without workpiece transport).

Figure 3:
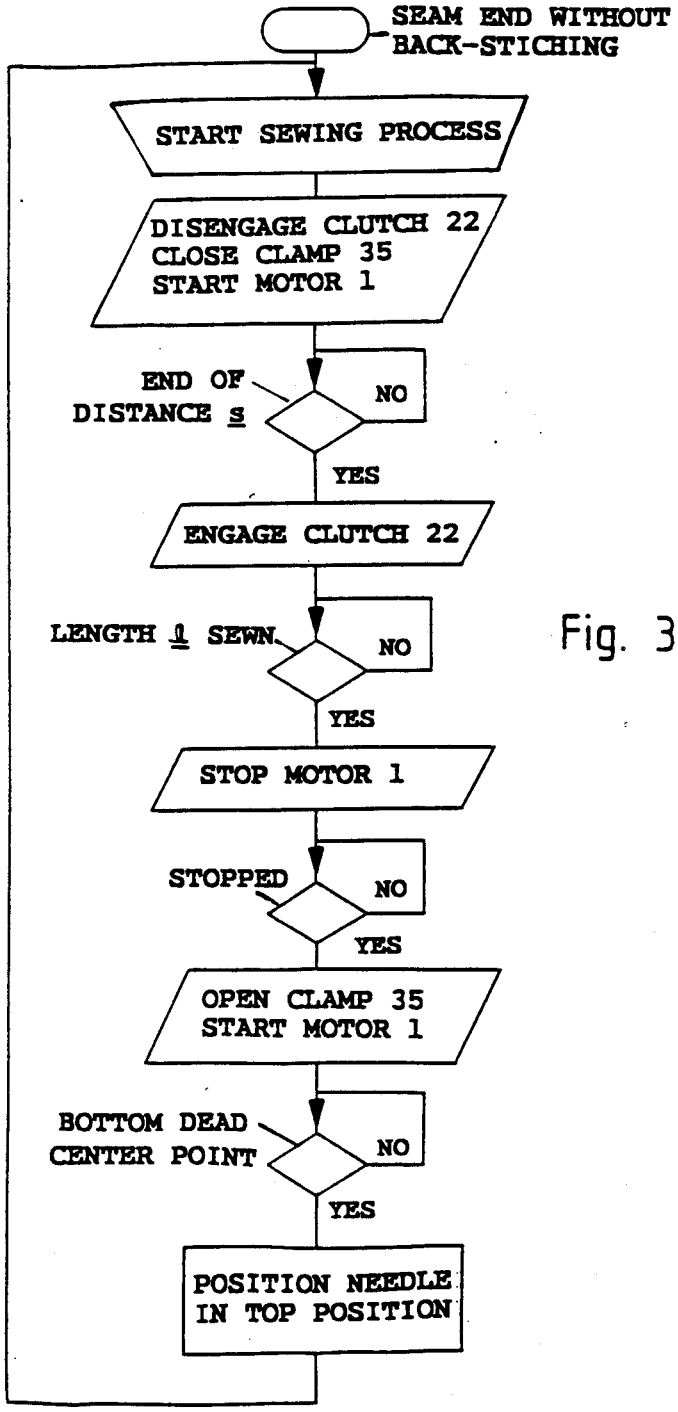
FIG. 3 is a flowchart showing how the machine is controlled according to one embodiment of the method.

This is enabled to happen by the means mentioned above for determining the bottom dead center point of the needle 13 and the defined needle top position, which means is, in turn, in operative connection with the control means 10. This means establishes whether the stitch formation has already been completed (i.e., whether the needle had reached its lowest position at the time of stopping), so that the needle 13 only needs to be transported out of the workpieces 7, *7a*; or whether the bottom dead center point has not yet been reached and is still to be passed through. If the needle 13 is in downward motion at the instant of stopping, then after passing through the bottom dead center point it is positioned, in known manner, in the previously defined needle top position. If it is exactly at the bottom dead center point at this instant of stopping, positioning in the needle top position takes place immediately afterward. If the needle 13 is in upward motion at the time of stopping, the needle stroke is then continued until the bottom dead center point is passed through—which is necessary to complete the formation of the stitch—and then the needle is positioned at the needle top position. FIG. 3 shows a flowchart on the basis of which the programming or wiring of the control unit 10 can be implemented for carrying out the foregoing operations.

After the workpiece transport and the needle stroke have been stopped in accordance with the foregoing, and if the sewing machine 3 is restarted, then when the needle 13 again passes through the top dead center point, the thread cutter, not shown, is actuated in order to part the thread at the termination of the seam. This has long been known and requires no special explanation for the specialist.

Figure 4:
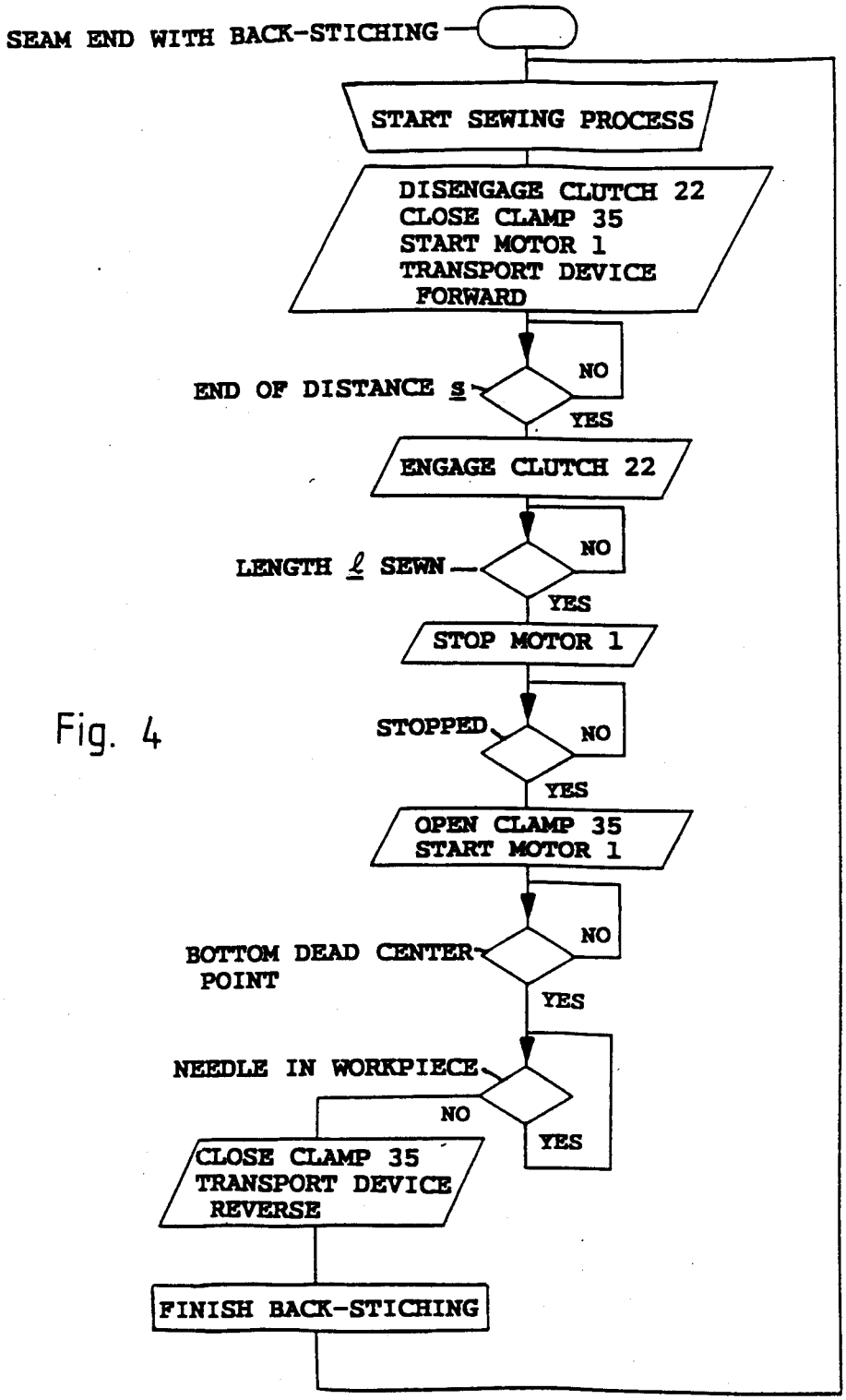
FIG. 4 is a flowchart showing the control of the machine according to another embodiment of the method.
Figure 5:
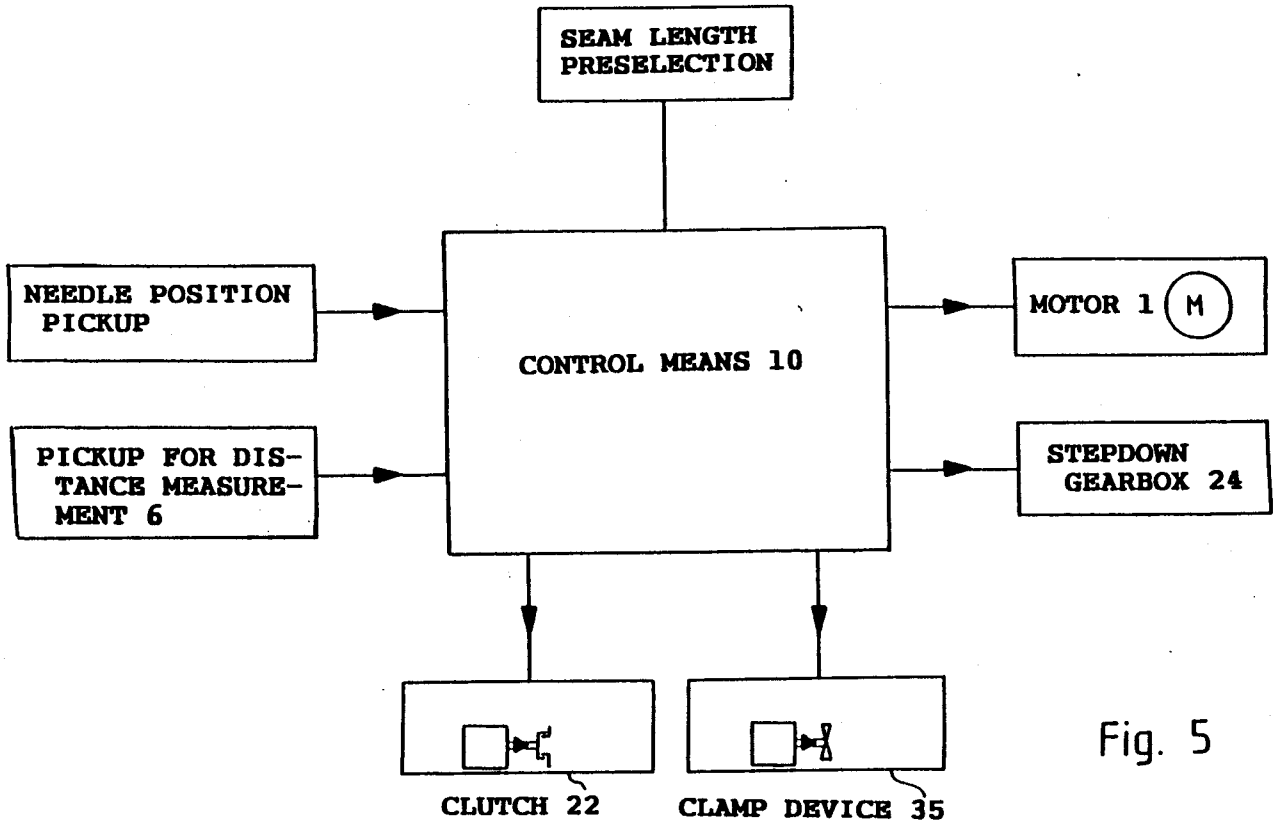
FIG. 5 is a simplified block diagram of the control unit and the components connected to it.

In the event that the seam is to be terminated with back-stitching, the control unit 10 must be so programmed that the sewing machine is started without the workpiece transport engaged. When the needle 13 leaves the workpieces 7, *7a* after the first passage through the bottom dead center point, the workpiece transport is engaged in the direction opposite to the original sewing direction. In the example shown diagrammatically in FIG. 1, the reversal of the workpiece transport can be achieved by changing the direction of rotation of gearbox 24. After a predetermined number of stitches, the back-stitching is ended in known manner. FIG. 4 shows a flowchart of a control process for carrying out this operation.

It would also, however, be conceivable in principle to drive the transport device 4 and the sewing machine 3 by separate motors, so that neither the clutch 22, 22*a*, 22*b* nor the gearbox 24, would be necessary. Each motor would be controlled individually by the control unit 10 in a manner analogous to the above description.

Figure 2A:
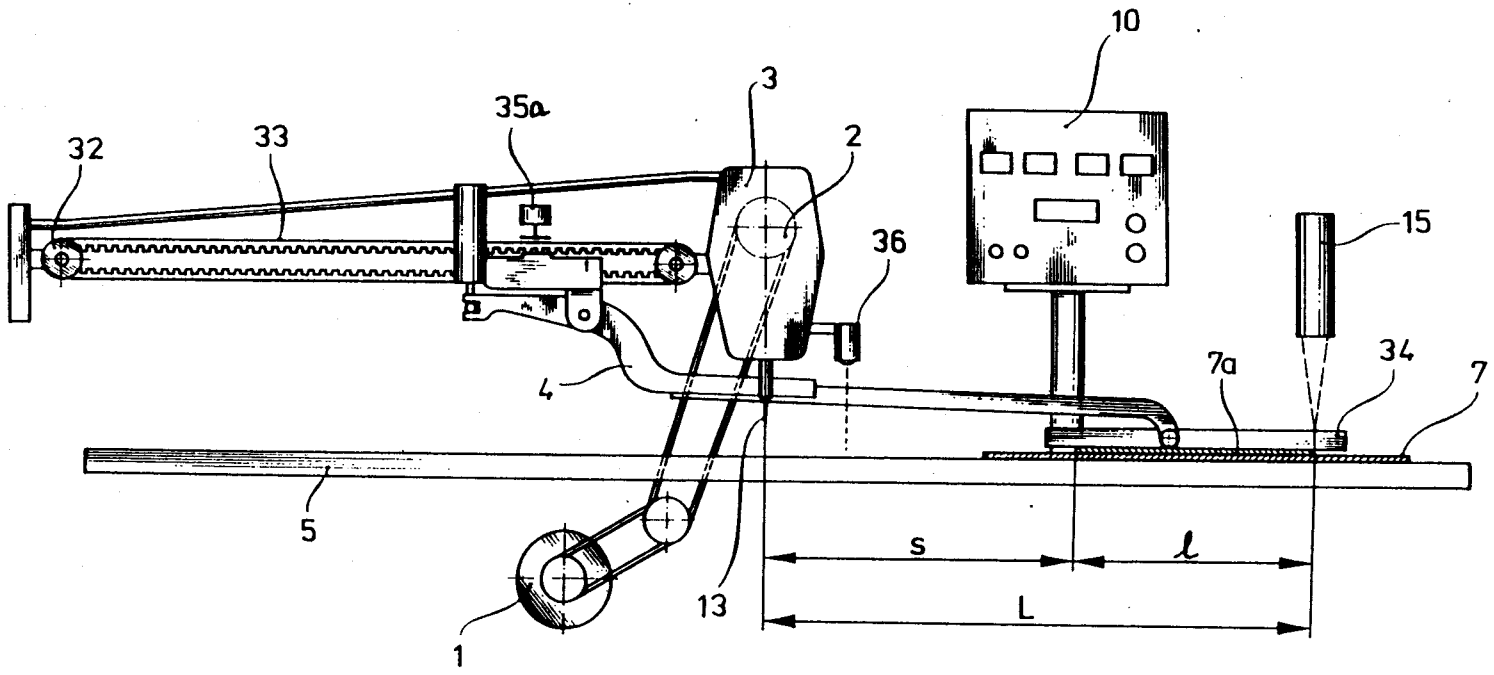
FIG. 2*a* is a side view similar to FIG. 2, showing a further embodiment of a sewing machine according to the invention.

The feasibility of this method is independent of the manner in which the desired seam end is detected. It can also be used when the seam end is determined by edge detection with an optoelectronic sensor 36 (FIG. 2*a*). From the known distance between the needle and the sensor 36, the control unit, with the help of distance measurement, could derive signals by means of which the last stitch is positioned at the desired location in the manner described.

Although embodiments of the invention have been described herein, the claimed invention is not to be considered as limited to such embodiments, but rather to cover any modifications and variations of the teachings herein that may occur to one having ordinary skill in the art.

What is claimed is:

1. A method for sewing a seam which ends at a predetermined end point in a workpiece, by means of an automatic sewing machine having a needle, a workpiece transport device, and drive means for driving said needle and workpiece transport device, comprising the steps of:

sewing the seam by employing the workpiece transport device to automatically pass the workpiece in a forward direction under the ascending and descending needle of the sewing machine;

monitoring when said workpiece reaches a predetermined location with the needle being at said seam end point;

when the predetermined location is reached, automatically interrupting the forward movement of the workpiece; and automatically completing the formation of any last stitch that had been begun at the time of the interruption, but not making any additional forward stitches.

2. A sewing method as in claim 1, wherein the interruption of the forward movement of the sewing material takes place independently of the instantaneous position of the needle at the time of the interruption.

3. A method for sewing a seam which ends at a predetermined end point in a workpiece, by means of an automatic sewing machine having a needle, a workpiece transport device, and drive means for driving said needle and workpiece transport device, comprising the steps of:

sewing the seam by employing the workpiece transport device to automatically pass the workpiece in a forward direction under the ascending and descending needle of the sewing machine;

monitoring when said workpiece reaches a predetermined location with the needle being at said seam end point;

when the predetermined location is reached, automatically interrupting the forward movement of the workpiece; and automatically completing the formation of any last stitch that had been begun at the time of the interruption, but not making any additional forward stitches;

wherein the forward movement of the workpiece and the stroke movement of the needle are interrupted simultaneously; and then the workpiece transport device is disabled and the stroke movement of the needle is automatically restarted to complete the formation of said last stitch.

4. A sewing method as in claim 1, wherein said monitoring of when said workpiece reaches said predetermined location is performed by the steps of:

placing said workpiece in an initial position;

predetermining a length l of said seam to be sewn;

predetermining a distance L from the end point of said seam with the workpiece in said initial position, to the needle;

calculating a distance $s=L-l$;

moving the workpiece toward the needle by said distance s from the initial position; then beginning said sewing of the seam; and continuing said sewing until the workpiece has additionally been moved said distance l.

5. A method as in claim 3, wherein said monitoring of when said workpiece reaches said predetermined location is performed by sensing the passage of an edge of said workpiece past a sensing point at a known distance from said needle, and in response thereto, deriving signals representative of when the forward movement of the workpiece is to be interrupted.

6. A method for sewing a seam which ends at a predetermined end point in a workpiece, by means of an automatic sewing machine having a needle, a workpiece transport device, and drive means for driving said needle and workpiece transport device, comprising the steps of:

sewing the seam by employing the workpiece transport device to automatically pass the workpiece in a forward direction under the ascending and descending needle of the sewing machine;

monitoring when said workpiece reaches a predetermined location with the needle being at said seam end point;

when the predetermined location is reached, automatically interrupting the forward movement of the workpiece; and automatically completing the formation of any last stitch that had been begun at the time of the interruption, but not making any additional forward stitches;

wherein said step of automatically completing the formation of any last stitch comprises the steps of:

defining a needle top position and a bottom dead center point;

at the time of workpiece movement interruption, determining the direction of needle movement and whether the bottom dead center point has been reached;

if the needle is at said bottom dead center point or in downward movement at said time, then returning the needle to said needle top position to complete such last stitch; and if the needle is in upward movement at said time, then continuing needle movement until the bottom dead center point is again passed through and then returning the needle to the needle top position to complete the formation of such last stitch.

7. A method for sewing a seam which ends at a predetermined end point in a workpiece, by means of an automatic sewing machine having a needle, a workpiece transport device, and drive means for diving said needle and workpiece transport device, comprising the steps of:

sewing the seam by employing the workpiece transport device to automatically pass the workpiece in a forward direction under the ascending and descending needle of the sewing machine;

monitoring when said workpiece reaches a predetermined location with the needle being at said seam end point;

when the predetermined location is reached, automatically interrupting the forward movement of the workpiece; and automatically completing the formation of any last stitch that had been begun at the time of the interruption, but not making any additional forward stitches;

further comprising the steps of:

after completing such last stitch, restarting the drive means to drive the sewing machine but not the workpiece transport device; and after the first passage of the needle through the bottom dead center position, engaging the workpiece transport device in a reverse direction to terminate the seam with a predetermined number of backstitches.

8. An apparatus for sewing a seam which ends at a predetermined end point in a workpiece, comprising:

an automatic sewing machine having an ascending and descending needle;

workpiece transport means which is operable for automatically passing the workpiece under the ascending and descending needle of the sewing machine;

drive means for driving said needle and workpiece transport means; and control means for controlling said sewing machine, said workpiece transport means, and said drive means; said control means carrying out the steps of:

monitoring when said workpiece reaches a predetermined location with the needle being at said seam end point;

interrupting the forward movement of the workpiece when the predetermined location is reached; and operating the needle for completing the formation of any last stitch that had been begun at the time of the interruption, but not making any additional forward stitches.

9. A sewing apparatus as in claim 8, wherein said control means interrupts the forward movement of the sewing material independently of the instantaneous position of the needle at the time of the interruption.

10. An apparatus for sewing a seam which ends at a predetermined end point in a workpiece, comprising:

an automatic sewing machine having an ascending and descending needle;

workpiece transport means which is operable for passing the workpiece under the ascending and descending needle of the sewing machine;

drive means for driving said needle and workpiece transport means; and control means for controlling said sewing machine, said workpiece transport means, and said drive means; said control means carrying out the steps of:

monitoring when said workpiece reaches a predetermined location with the needle being at said seam end point;

interrupting the forward movement of the workpiece when the predetermined location is reached; and operating the needle for completing the formation of any last stitch that had been begun at the time of the interruption, but not making any additional forward stitches;

wherein said control means interrupts the forward movement of the workpiece and the stroke movement of the needle simultaneously; and then disables the workpiece transport device and restarts the stroke movement of the needle to complete the formation of said last stitch.

11. A sewing apparatus as in claim 8, wherein said control means monitors when said workpiece reaches said predetermined location by:

predetermining a length l of said seam to be sewn;

predetermining a distance L from the end point of said seam to the needle, said workpiece being placed in a predetermined initial position;

calculating a distance $s=L-l$; and moving the workpiece said distance s from the initial position; then beginning said sewing of the seam; and continuing said sewing until the workpiece has additionally been moved said distance l.

12. A sewing apparatus as in claim 10, wherein said control means for monitoring when said workpiece reaches said predetermined location includes means for sensing the passage of an edge of said workpiece past a sensing point at a known distance from said needle, and in response thereto, deriving signals representative of when the forward movement of the workpiece is to be interrupted.

13. A sewing apparatus as in claim 12, wherein said means for sensing the passage of a workpiece edge includes an optoelectronic sensor mounted at said sensing point.

14. A sewing apparatus as in claim 10, further comprising:

needle sensing means on the sewing machine for determining the present position of the sewing needle in relation to a predetermined top position, a top dead center position, and a bottom dead center position and producing a signal representing said needle position.

15. An apparatus for sewing a seam which ends at a predetermined end point in a workpiece, comprising:

an automatic sewing machine having an ascending and descending needle;

workpiece transport means which is operable for passing the workpiece under the ascending and descending needle of the sewing machine;

drive means for driving said needle and workpiece transport means; and control means for controlling said sewing machine, said workpiece transport means, and said drive means; said control means carrying out the steps of:

monitoring when said workpiece reaches a predetermined location with the needle being at said seam end point;

interrupting the forward movement of the workpiece when the predetermined location is reached; and operating the needle for completing the formation of any last stitch that had been begun at the time of the interruption, but not making any additional forward stitches;

wherein said control means is operable for automatically completing the formation of any last stitch by the steps of:

defining a needle top position and a bottom dead center point;

at the time of workpiece movement interruption, determining the direction of needle movement and whether the bottom dead center point has been reached;

if the needle is at said bottom dead center point or in downward movement at said time, then returning the needle to said needle top position to complete such last stitch; and if the needle is in upward movement at said time, then continuing needle movement until the bottom dead center point is again passed through and then returning the needle to the needle top position to complete the formation of such last stitch.

16. An apparatus for sewing a seam which ends at a predetermined end point in a workpiece, comprising:

an automatic sewing machine having an ascending and descending needle;

workpiece transport means which is operable for passing the workpiece under the ascending and descending needle of the sewing machine;

drive means for driving said needle and workpiece transport means; and control means for controlling said sewing machine, said workpiece transport means, and said drive means; said control means carrying out the steps of:

monitoring when said workpiece reaches a predetermined location with the needle being at said seam end point;

interrupting the forward movement of the workpiece when the predetermined location is reached; and operating the needle for completing the formation of any last stitch that had been begun at the time of the interruption, but not making any additional forward stitches;

wherein said control means is further operable for:

after completing such last stitch, restarting the drive means to drive the sewing machine but not the workpiece transport device; and after the first passage of the needle through the bottom dead center position, engaging the workpiece transport device in a reverse direction to terminate the seam with a predetermined number of backstitches.

17. A sewing apparatus as in claim 11, further comprising:

distance sensing means associated with the workpiece transport device for detecting the distance that a workpiece is moved by the workpiece transport device.

18. A sewing method as in claim 3, wherein said step of automatically completing the formation of any last stitch comprises the steps of:

defining a needle top position and a bottom dead center point;

at the time of workpiece movement interruption, determining the direction of needle movement and whether the bottom dead center point has been reached;

if the needle is at said bottom dead center point or in downward movement at said time, then returning the needle to said needle top position to complete such last stitch; and if the needle is in upward movement at said time, then continuing needle movement until the bottom dead center point is again passed through and then returning the needle to the needle top position to complete the formation of such last stitch.

19. A sewing method as in claim 18, further comprising the steps of:

after completing such last stitch, restarting the drive means to drive the sewing machine but not the workpiece transport device; and after the first passage of the needle through the bottom dead center position, engaging the workpiece transport device in a reverse direction to terminate the seam with a predetermined number of backstitches.

20. A sewing apparatus as in claim 15, further comprising:

needle sensing means on the sewing machine for determining the present position of the sewing needle in relation to a predetermined top position, a top dead center position, and a bottom dead center position and producing a signal representing said needle position.

21. A sewing apparatus as in claim 10, wherein said control means is operable for automatically completing the formation of any last stitch by the steps of:

defining a needle top position and a bottom dead center point;

at the time of workpiece movement interruption, determining the direction of needle movement and whether the bottom dead center point has been reached;

if the needle is at said bottom dead center point or in downward movement at aid time, then returning the needle to said needle top position to complete such last stitch; and if the needle is in upward movement at said time, then continuing needle movement until the bottom dead center point is again passed through and then returning the needle to the needle top position to complete the formation of such last stitch.

22. A sewing apparatus as in claim 21, wherein said control means is further operable for:

after completing such last stitch, restarting the drive means to drive the sewing machine but not the workpiece transport device; and after the first passage of the needle through the bottom dead center position, engaging the workpiece transport device in a reverse direction to terminate the seam with a predetermined number of backstitches.

23. A sewing apparatus as in claim 22, further comprising:

needle sensing means on the sewing machine for determining the present position of the sewing needle in relation to a predetermined top position, a top dead center position, and a bottom dead center position and producing a signal representing said needle position.

24. Sewing unit for sewing a seam having a prescribed length, comprising a sewing machine which comprises: a needle that travels up and down and produces stitches in a material being sewn; a pusher that automatically advances the material being sewn in a straight line under the needle, said pusher being coupled to a drive train; control means for controlling the drive train, the pusher and the needle; the control means being responsive to a sensor that senses the motion of the drive train; said control means being operable for storing the prescribed seam length therein; the sensor communicates the length of seam actually sewn to the control means; once the control means recognizes that a seam of the prescribed length has been sewn, it disengages the pusher from the drive train while simultaneously discontinuing the travel of the needle; and the control means discontinues the current stitch-production process the instant it recognizes that a seam of the prescribed length has been sewn by conclusively braking the advance of the material by the pusher, and reinitiating the discontinued needle travel until one stitch has been completely produced.

* * * * *